US006223827B1

(12) United States Patent
Zuev et al.

(10) Patent No.: US 6,223,827 B1
(45) Date of Patent: May 1, 2001

(54) FIRE-EXTINGUISHING EQUIPMENT

(75) Inventors: Jury Vladimirovich Zuev, Moskovskaya obl.; Alexandr Vladimirovich Karpyshev; Igor Alexandrovich Lepeshinky, both of Moscow, all of (RU)

(73) Assignee: Nauchno-Issledovatelsky Institut Nizkikh Temperatur Pri Mai (RU)

( * ) Notice: Subject to any disclaimer, the term of this patent is extended or adjusted under 35 U.S.C. 154(b) by 0 days.

(21) Appl. No.: 09/423,687

(22) PCT Filed: Apr. 13, 1998

(86) PCT No.: PCT/RU98/00118

§ 371 Date: Dec. 29, 1999

§ 102(e) Date: Dec. 29, 1999

(87) PCT Pub. No.: WO98/51374

PCT Pub. Date: Nov. 19, 1998

(30) Foreign Application Priority Data

May 14, 1997 (RU) ..... 97107903

(51) Int. Cl.[7] ..... A62C 35/00

(52) U.S. Cl. ..... 169/9; 169/14; 169/30; 169/74; 239/152; 239/311

(58) Field of Search ..... 169/9, 14, 15, 169/30, 71, 74, 85; 239/152, 303, 308, 311, 433, 434, 398, 434.5; 222/195, 399, 175

(56) References Cited

U.S. PATENT DOCUMENTS

| | | | | |
|---|---|---|---|---|
| 2,832,425 | * | 4/1958 | Jacobs | 169/85 |
| 2,990,165 | * | 6/1961 | Joseph | 169/15 |
| 5,330,105 | * | 7/1994 | Kaylor | 169/15 |
| 5,623,995 | * | 4/1997 | Smagac | 169/85 |

* cited by examiner

*Primary Examiner*—Lisa Ann Douglas
(74) *Attorney, Agent, or Firm*—Rothwell, Figg, Ernst & Manbeck

(57) ABSTRACT

A fire-extinguishing device includes a vessel containing a fire-extinguishing substance, a tank of pressurized gas, flexible pipe for connecting the vessel and the tank to each other as well as to a device that generates a directed flow of the fire-extinguishing substance mixed with the working gas, and a pressure regulator for the working gas. The device has a mixing chamber for the fire-extinguishing substance and the gas, with the chamber having a gas-dynamic nozzle mounted at its outlet. A profiled channel in the nozzle has a length equal to at least twice the diameter of the nozzle channel at its smallest section. The vessel and the tank may be fitted in a backpack. The nozzle may be made in the shape of ring and fitted with an annular channel for feeding additional working gas before a minimal section of its own channel. The central body of the annular nozzle may be made in the shape of a cone with its tip directed toward the nozzle inlet.

5 Claims, 5 Drawing Sheets

FIRE-EXTINGUISHING EQUIPMENT

FIELD OF THE ART

The invention relates to fire fighting equipment and is aimed at providing gas-liquid jets and mist screens, foam, and gas and powder jets.

STATE OF THE ART

Known in the art are fire extinguishing apparatus having devices for spraying liquid.

These prior art apparatus have a liquid and gas supply system and a gas dynamic nozzle which has a chamber for mixing liquid and gas (RU 94003528A, A62C31/02, 1995).

During operation of the prior art apparatus, a gas flow is accelerated in the gas dynamic nozzle, a dispersed liquid flow is injected into the gas flow during the acceleration, and the resulting two-phase flow is accelerated in the nozzle.

The most closely analogous device in the prior art is a portable fire extinguishing apparatus which has a vessel containing a fire extinguishing substance, at least one compressed gas bottle, flexible hoses connecting the vessel to the bottle, and an impulse device (a gun) for shooting the fire extinguishing substance, as well as a gas pressure regulator (IFEX 3000. Impulse Fire Extinguishing Technology. IFEX—Backpack Assembly IF-BP-300001-1. IFEX GmbH, Germany, 1995).

The fire extinguishing substance is expelled in the form of impulses at high velocity during a short time interval. The shot can be aimed in any direction by turning the barrel. A rubber diaphragm installed in the barrel ensures the spraying of the jet. During operation of the apparatus, the fire extinguishing substance is shot at high velocity under the action of compressed gas in the direction toward the source of the fire.

The apparatus of the prior art cannot, however, ensure high velocity of the fire extinguishing substance if the distance from the object surface (fire source) increases, nor can it work continuously. For this reason, the apparatus has to be used at a short distance from the source of fire. In addition, the source of fire can flare up again while the system is being recharged. The apparatus of the prior art has limited capabilities for controlling the liquid flow dispersion, which restricts the fire-extinguishing efficiency of the apparatus.

SUMMARY OF THE INVENTION

The present invention is based on the problem of increasing the range of supply of a fire extinguishing substance and ensuring control of dispersion in both continuous and impulse system operation modes.

The solution to these technical problems is aimed at improving the overall efficiency in using the fire extinguishing substance and at increasing the speed at which fires are extinguished.

The above object is accomplished by the fact that in a portable fire extinguishing apparatus comprising at least one vessel containing a fire extinguishing substance and one compressed gas bottle, a device for forming a directional flow of the fire extinguishing substance mixed with gas, flexible hoses connecting the vessel to the bottle and to the apparatus, and a working gas regulator, according to the invention, the device is provided with a mixing chamber for mixing the fire extinguishing substance with the gas, and a gas dynamic nozzle installed at the outlet of the chamber.

The length of a profiled passage of the nozzle L is chosen based on the condition $L \geqq 2\ d_{min}$, wherein $d_{min}$ is the diameter of the nozzle in the minimum size cross-section.

To improve mobility of the apparatus, the vessel and the gas bottle may be installed in a backpack.

Water is preferably used as the fire extinguishing substance (with various additives).

An annular nozzle may be used to compact (compress) the gas-droplet jet.

The core of the annular nozzle is preferably made as a cone, with the vertex of the cone facing toward the entry to the nozzle.

To control the escape mode of the jet of the fire extinguishing substance, it is preferable that the nozzle have an annular passage for supplying the working gas upstream of the minimum size cross-section of the nozzle passage.

BRIEF DESCRIPTION OF THE DRAWINGS

A fire extinguishing apparatus according to the invention will now be described with reference to a specific embodiment illustrated in the accompanying drawings, wherein.

PREFERRED EMBODIMENTS OF THE INVENTION

Figure 1:
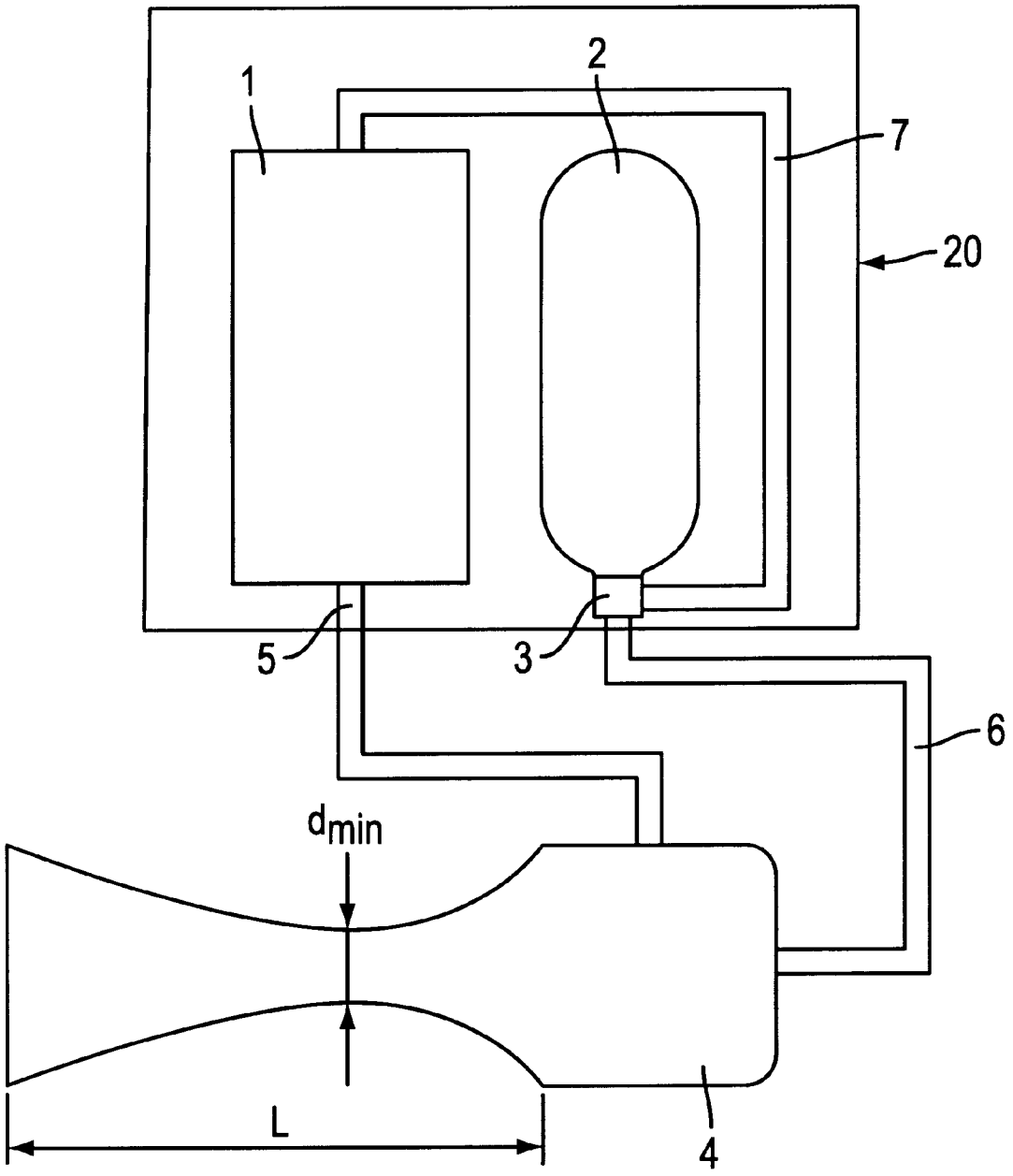
FIG. 1 is a general view of a portable fire extinguishing apparatus.

A portable fire extinguishing apparatus (FIG. 1) has a backpack 20 including a vessel 1 containing a fire extinguishing substance, a compressed gas bottle 2, a working gas pressure regulator 3, a device 4 for forming a directional flow of the fire extinguishing substance, flexible hoses 5 and 6 which connect the vessel 1 and the bottle 2 to the device 4 and a flexible hose 7 which connects the bottle 2 to a plenum of the vessel 1.

The vessel 1, which has a 12-liter capacity, is filled with water, and the vessel 2, which has a 2-liter capacity, is filled with compressed air.

The device 4 (FIG. 2) has a chamber 8 for mixing the fire extinguishing substance (water) with a working gas (air), having devices 9 and 10 for liquid and gas supply, respectively. A gas dynamic nozzle 11 is provided at the outlet of the chamber 8, and the length of a profiled passage of the nozzle is chosen based on the condition $L \geqq 2\ d_{min}$, wherein $d_{min}$ is the diameter of the nozzle in the minimum size cross-section. Water is fed through jet ports of a device for dispersing the flow into the chamber 8 in the form of individual jets 12. The mixing chamber 8 is used to form a two-phase flow with predetermined dispersion and to form a flow with a predetermined concentration of liquid drops.

Figure 3:
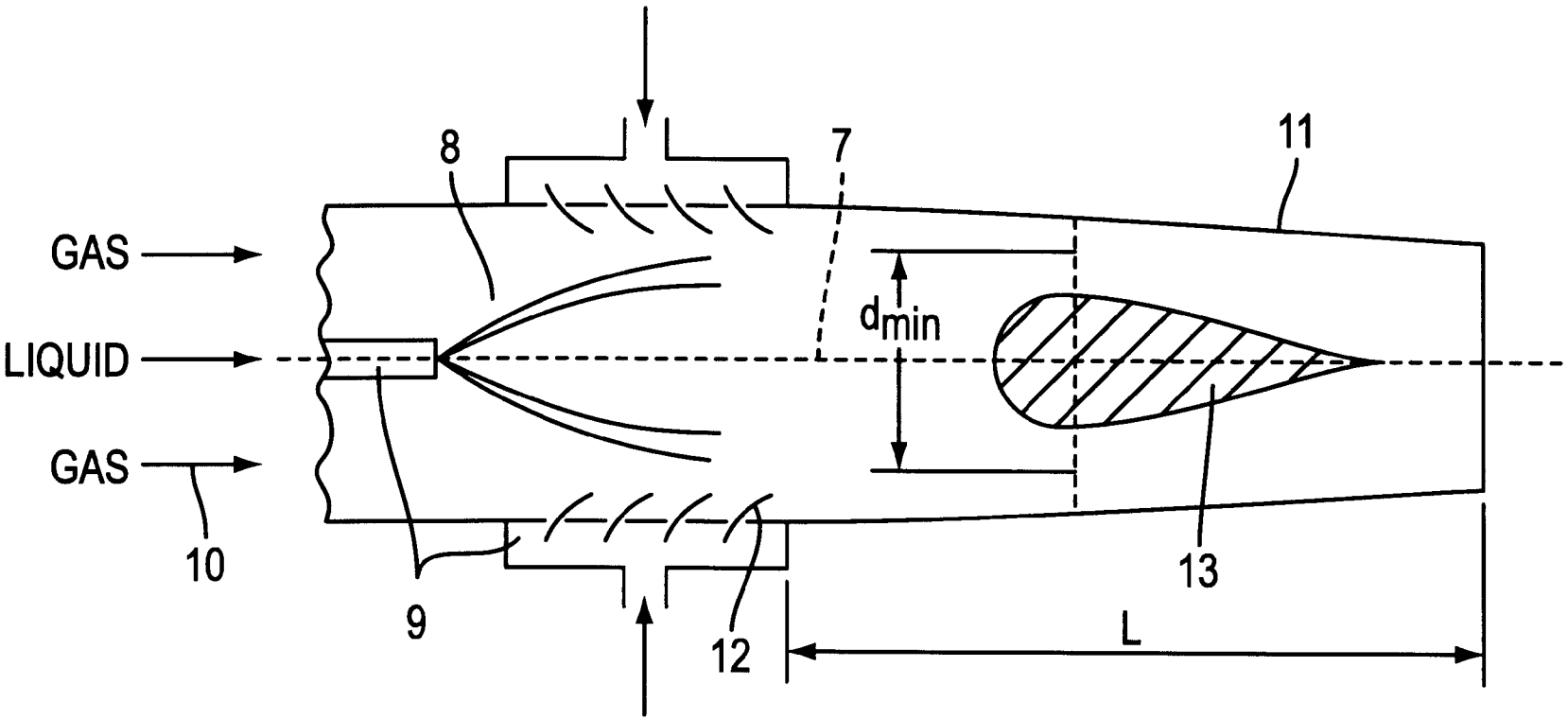
FIG. 3 is a schematic view of a gas dynamic nozzle in another embodiment (an annular nozzle)

In one embodiment of the apparatus according to the invention, an annular nozzle 11 is used (refer to FIG. 3) with a core 13 installed in a profiled passage of the nozzle.

Figure 4:
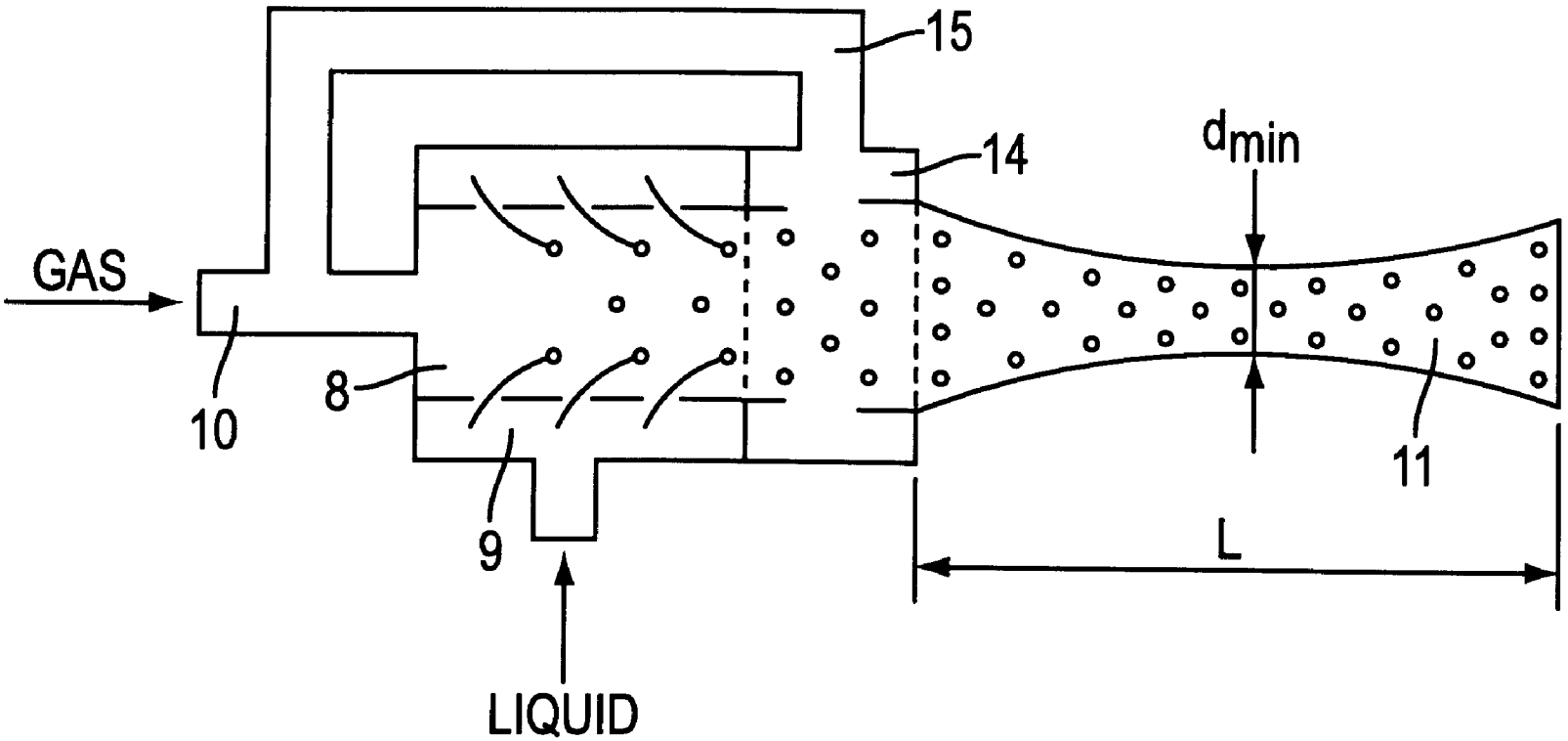
FIG. 4 is a schematic view of a gas dynamic nozzle having an auxiliary annular passage.

In another embodiment of the apparatus according to the invention, the nozzle 11 is provided with an auxiliary annular passage 14 (see FIG. 4) which is used to supply a working gas (air) through a pipeline 15 into the profiled passage of the nozzle upstream of its minimum size cross-section ($d_{min}$).

Figure 5:
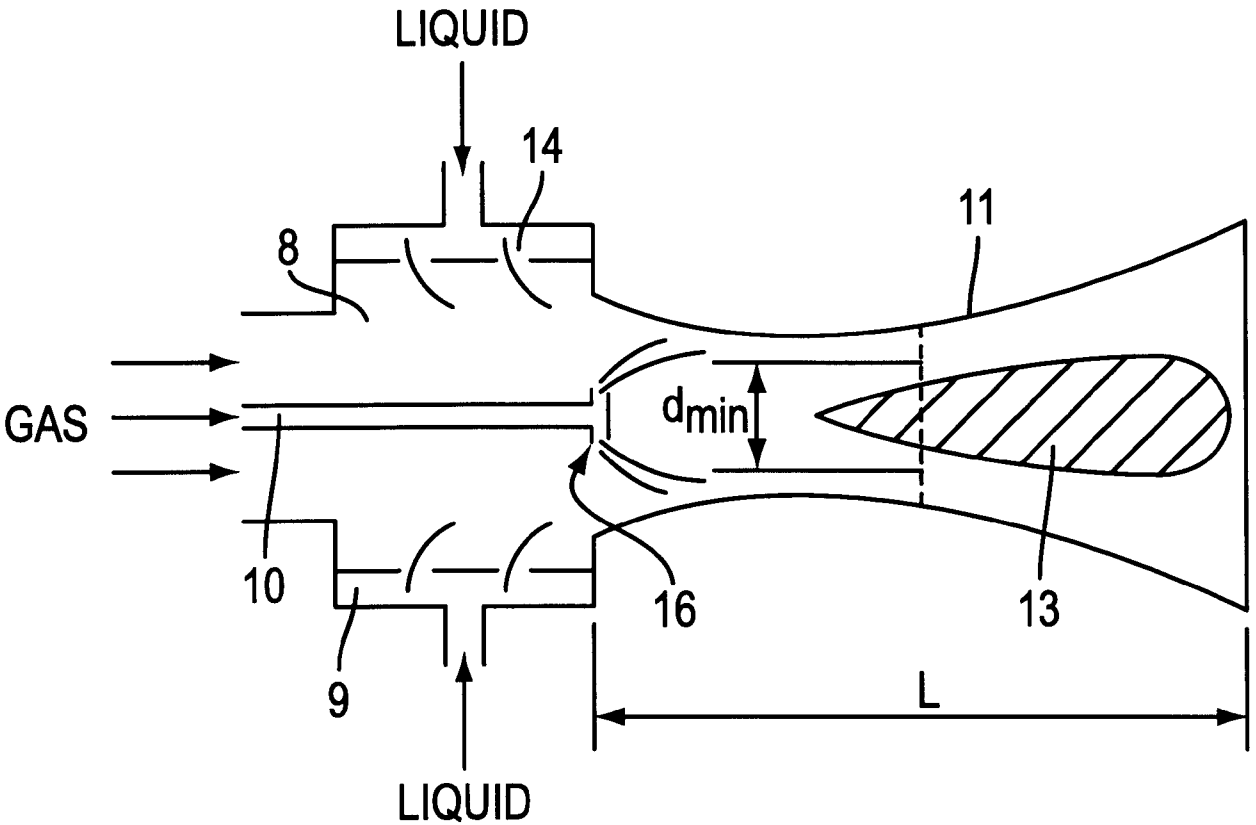
FIG. 5 is a schematic view of an annular gas dynamic nozzle with an auxiliary gas entry.

In a further embodiment of the apparatus according to the invention, the annular nozzle 11 has a device 16 for auxiliary gas supply which is installed on the axis of symmetry of the nozzle upstream of its minimum size cross-section (refer to FIG. 5).

The apparatus functions in the following manner.

Compressed air under pressure of 300 bar is supplied (FIG. 1) from the gas bottle 2 through the pressure regulator 3 (gas reduction valve), to ensure a preset pressure level, through the hose 7 into the plenum of the vessel 1 containing water (the gas pressure is 6 bar) and is then fed to the mixing chamber 8 (the gas pressure is 5 bar) through the flexible hose 5 through the gas supply device 10.

Figure 2:
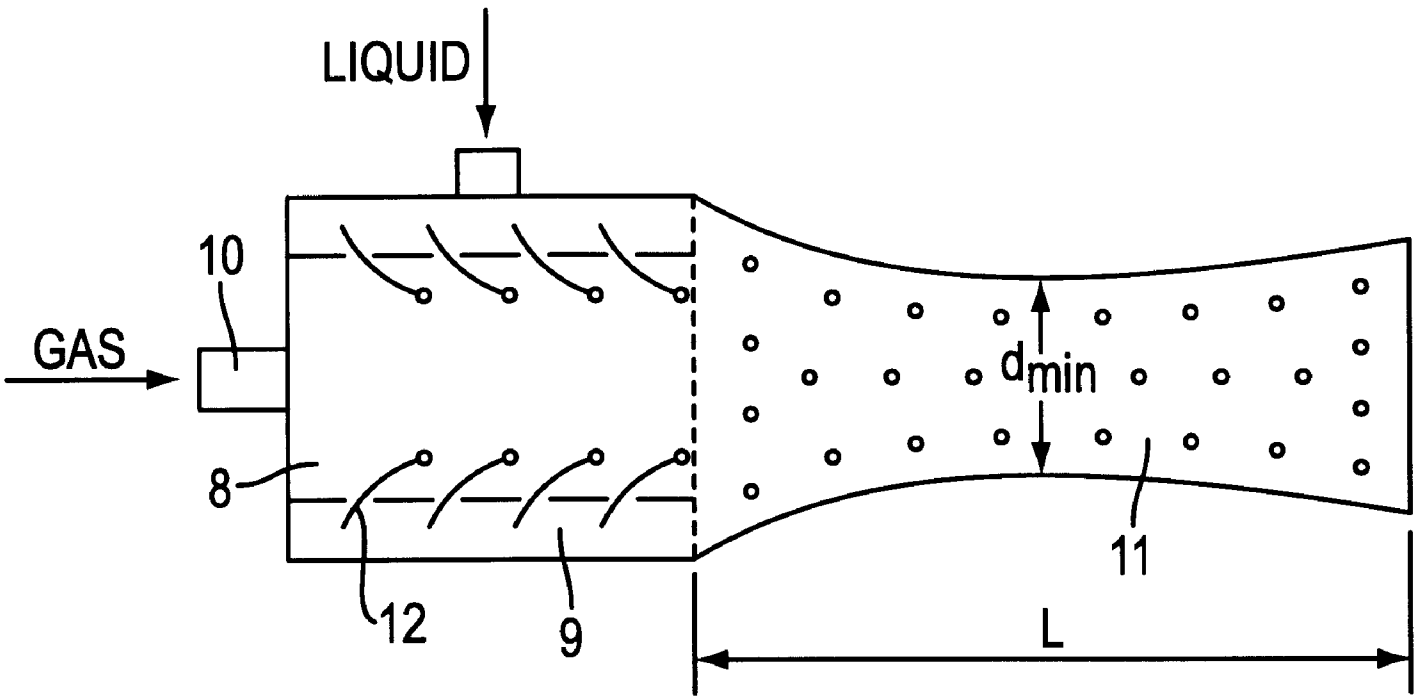
FIG. 2 is a schematic view of a gas dynamic nozzle having a mixing chamber.

Water which is displaced with the gas is supplied from the vessel 1 through the flexible hose 5 into the mixing chamber though the liquid supply devices 9 (refer to FIG. 2). To ensure the uniform atomizing of water in the mixing chamber, jet nozzles are used as the devices 9.

Water which is injected in the form of individual jets 12 is mixed in the chamber 8 with the incoming air flow, resulting in a two-phase (gas-droplet) flow being formed.

The air pressure at the entry to the nozzle and the relative concentration of water in the two-phase flow are chosen to obtain the optimum characteristics of the resulting two-phase jet.

The minimum possible gas pressure and the relative concentration of the liquid are chosen to obtain the maximum density of particles (drops) in the gas stream. This condition ensures the formation of the liquid drop phase in the gas.

The two-phase flow which is formed in the mixing chamber 8 is accelerated in the profiled passage of the nozzle 11. The use of the annular nozzle 11 having the core 13 (refer to FIG. 3) allows the gas-droplet jet to be compacted (compressed), while having relatively uniform distribution of water drops throughout the cross-section of the jet.

The required uniformity of dispersion of the fire extinguishing substance and uniformity of finely dispersed drops (D=50 +e,fra i+ee m), as well as the desired long-range capability of the gas-droplet jet (up to 30 m) are achieved with a predetermined length of the profiled passage of the nozzle 11. Thus the length L of the nozzle 11 is chosen accordingly, depending on the diameter of the minimum size cross-section of the nozzle $d_{min}$: $L=2\ d_{min}$.

The flow escape mode control and control of parameters of the two-phase flow are carried out by supplying air through the pipeline 15 into the annular passage 14 (refer to FIG. 4), from which the air enters the profiled passage directly upstream of the minimum size cross-section of the passage. The controlled supply of the auxiliary air flow through the annular passage 14 allows the fine dispersion escape mode of the two-phase flow to be changed to the compact jet flow with coarser drops. The supply of the auxiliary air through the passage 14 also allows the range of the fire-extinguishing substance jet supply and the spray angle to be controlled.

To change the cross-sectional size of the jet (refer to FIG. 5), the nozzle 11 has the core 13 and an auxiliary radial air supply through a device 16 installed on the centerline of the nozzle 11 upstream of the minimum size cross-section of its passage ($d_{min}$). When the gas supply through the device 16 is varied, the angle of spray of the gas-droplet jet is controlled.

The experimental results attest to the fact that it is possible to obtain preset uniformity of the atomizing of the fire extinguishing substance with a preset drop size in the flow and with the range of supply of the sprayed jet from several meters to 40 meters.

Depending on the size and quantity of the vessels 1 and gas bottles 2, the apparatus can be transported by using various means.

If the vessel 11 is of relatively small size (with a maximum capacity of 15 l) and the gas bottle 2 is as well, the apparatus can be accommodated in a backpack, thus greatly facilitating its transportation.

If the vessel (or vessels) and gas bottles are of relatively large size, the apparatus can be installed on a vehicle, e.g., on a motor vehicle or on an electric vehicle.

The simplest and most convenient means of transportation for the fire extinguishing apparatus may be a wheel cart on which the vessels and a gas bottle are mounted. Such vehicles are well known in the art, including the fire fighting field (refer, e.g., to DE 2635531A1, published Feb. 9, 1978, A62C31/02).

The above information confirms that the apparatus according to the invention can be used for fire extinguishing and can meet the objective of a longer supply range for a high-velocity flow of the fire extinguishing substance with dispersion control of the fire extinguishing substance during two-phase flow.

Industrial Application

The invention may be used for fire extinguishing under various conditions, including closed premises and inaccessible objects.

The backpack apparatus allows fire to be extinguished with the use of a minimum quantity of water, dry chemicals, and foaming liquid.

The apparatus according to the invention may be used for forming gas-liquid and mist screens, foam and gas, and powder jets.

Although the invention was described as it applies to the preferred embodiment of realization, it will be apparent to those skilled in the art that modifications and various options may be used without deviation from the general concept and subject matter of the invention. Such modifications and options do not exceed the spirit and scope of the invention as defined in the appended claims:

1. A fire extinguishing apparatus comprising at least one vessel containing a fire extinguishing liquid and one compressed gas bottle, a device for forming a directional gas-droplet flow with a mixing chamber for mixing liquid and gas, a gas regulator and flexible hoses connecting the vessel, the bottle and the device, wherein a gas dynamic nozzle for compressing and accelerating the gas-droplet flow is arranged at an outlet of the mixing chamber, the length L of a profiled passage of the nozzle being chosen so that $L \geqq 2\ d_{min}$, wherein $d_{min}$ is the minimum size cross-section diameter of the profiled passage of the nozzle.

2. The apparatus of claim 1, wherein the vessel and the gas bottle are accommodated in a backpack.

3. The apparatus of claim 1, wherein the nozzle is an annular nozzle.

4. The apparatus of claim 1, wherein the nozzle has an annular passage for supplying a working gas upstream of the minimum size cross-section of the nozzle.

5. The apparatus of claim 1, wherein an annular nozzle is used which has a core forming a cone with its vertex facing toward the entry to the nozzle.

* * * * *